US005918751A

United States Patent [19]

Kelly

[11] Patent Number: 5,918,751

[45] Date of Patent: Jul. 6, 1999

[54] DISPLAY TRAY

[75] Inventor: Daniel E. Kelly, Brookfield, Wis.

[73] Assignee: Tulip Corporation, Milwaukee, Wis.

[21] Appl. No.: 08/310,493

[22] Filed: Sep. 22, 1994

[51] Int. Cl.[6] ..... A47F 5/00

[52] U.S. Cl. ..... 211/194; 211/189; 211/126.2; 206/511

[58] Field of Search ..... 211/194, 188, 211/133, 126, 186, 187; 206/427, 432, 505, 509, 511, 512

[56] References Cited

U.S. PATENT DOCUMENTS

| | | | |
|---|---|---|---|
| 3,964,810 | 6/1976 | Murphy | 211/188 X |
| 4,199,069 | 4/1980 | Talarico | 211/194 |
| 4,467,927 | 8/1984 | Nathan | 211/186 X |
| 4,621,740 | 11/1986 | Lang | 211/194 X |
| 4,930,643 | 6/1990 | Flum | 211/194 X |
| 4,940,150 | 7/1990 | Spengler | 211/194 X |
| 4,981,224 | 1/1991 | Rushing | 211/194 X |
| 5,158,187 | 10/1992 | Taub | 211/188 X |
| 5,335,814 | 8/1994 | Hepp | 206/511 X |

*Primary Examiner*—Robert W. Gibson, Jr.
*Attorney, Agent, or Firm*—Foley & Lardner

[57] ABSTRACT

A display rack for soda bottles or the like, the rack including a number of trays each having a pillar in each corner of the tray and a post seated on the top of a corner pillar of a lower tray and seated in the bottom of a corner pillar on an upper tray to thereby provide a space sufficient for removal of bottles from any tray in the rack.

1 Claim, 5 Drawing Sheets

DISPLAY TRAY

FIELD OF THE INVENTION

This invention generally relates to a display rack formed by storage trays of the type which are adapted to hold bottles and more particularly to molded plastic trays having corner pillars which can be nested for storage and stacked on posts seated in the corner pillars to expose the bottles for display and removal from any tray in the rack.

BACKGROUND OF THE INVENTION

Soft drink bottles are ordinarily packaged by bottlers in cases holding several plastic or glass bottles for shipment to retailers or for storage. The cases are customarily stacked on top of the bottles in the lower tray for storage in warehouses. The trays must therefore be particularly stable in order to remain standing in storage. The bottles are generally stored in plastic low depth cases in which the side walls of the cases are lower than the height of the bottles and in which the bottles support the weight of the cases stacked on top of the bottles. When cases of these are stacked for display, the only bottles which can be removed from the stack are those stored in the top case.

Currently in order for a bottle to be displayed, it must be removed from the tray and placed in a display rack. If the trays are stacked on the bottles for display, the bottles can only be removed from the top tray. The top tray is removed from the stack when empty to provide access to the bottles on the next tray. Trays stacked on the tops of the bottles in the lower trays are unstable, particularly when bottles are removed from the lower trays while in storage.

SUMMARY OF THE PRESENT INVENTION

The trays of the present invention are similar to the trays described above. However, the pillars provided in each corner of the tray are recessed both in the top and the bottom. The trays are stacked for storage with the pillars on the bottom tray nested in the recesses in the bottom of the pillars in the upper tray. A display rack is formed by positioning posts in the recesses in the openings in the top of the corner pillars. A second tray is seated on the top of the posts with the upper end of the posts seated in the opening in the bottom of the corner pillar of the upper tray and the upper tray is thereby spaced from the lower tray a distance sufficient for removal of a bottle from the lower tray. With this arrangement sufficient space is provided for removing the bottles from the trays at any level, thus allowing for easier access to a variety of bottles or the like.

The primary object of the invention is to provide a bottle display rack formed by trays supported on posts seated in the corners of the trays which provide sufficient space for removal of bottles from any tray in the rack.

One advantage of the present invention is the ability to nest the trays for storage and thereby reduce the storage space required for storing the trays by 40%.

The post design provides excellent bottle support as well as label visibility. This arrangement enhances safety during handling and enhances the products image to the public.

In a second embodiment of the invention, the four corners of the trays are designed to accept a plastic post having a truncated member at the top and a truncated opening at the bottom. The truncated member fits into a truncated opening in the bottom of the corner pillar in the upper tray. The truncated opening in the bottom of the post is seated on a similar truncated opening in the corner posts in the lower tray. This arrangement is unique to this type of product. The four corner posts provide a permanent shelved style rack to be built which allows for product removal from any side of the trays. This rack relies on the stability of the posts rather than the tops of the bottles.

A further advantage of the invention is the elimination of the labor required to remove bottles for display in specialized display racks.

Other principal features and advantages of the invention will become apparent to those skilled in the art upon review of the following drawings, the detailed description and the appended claims.

Figure 1:
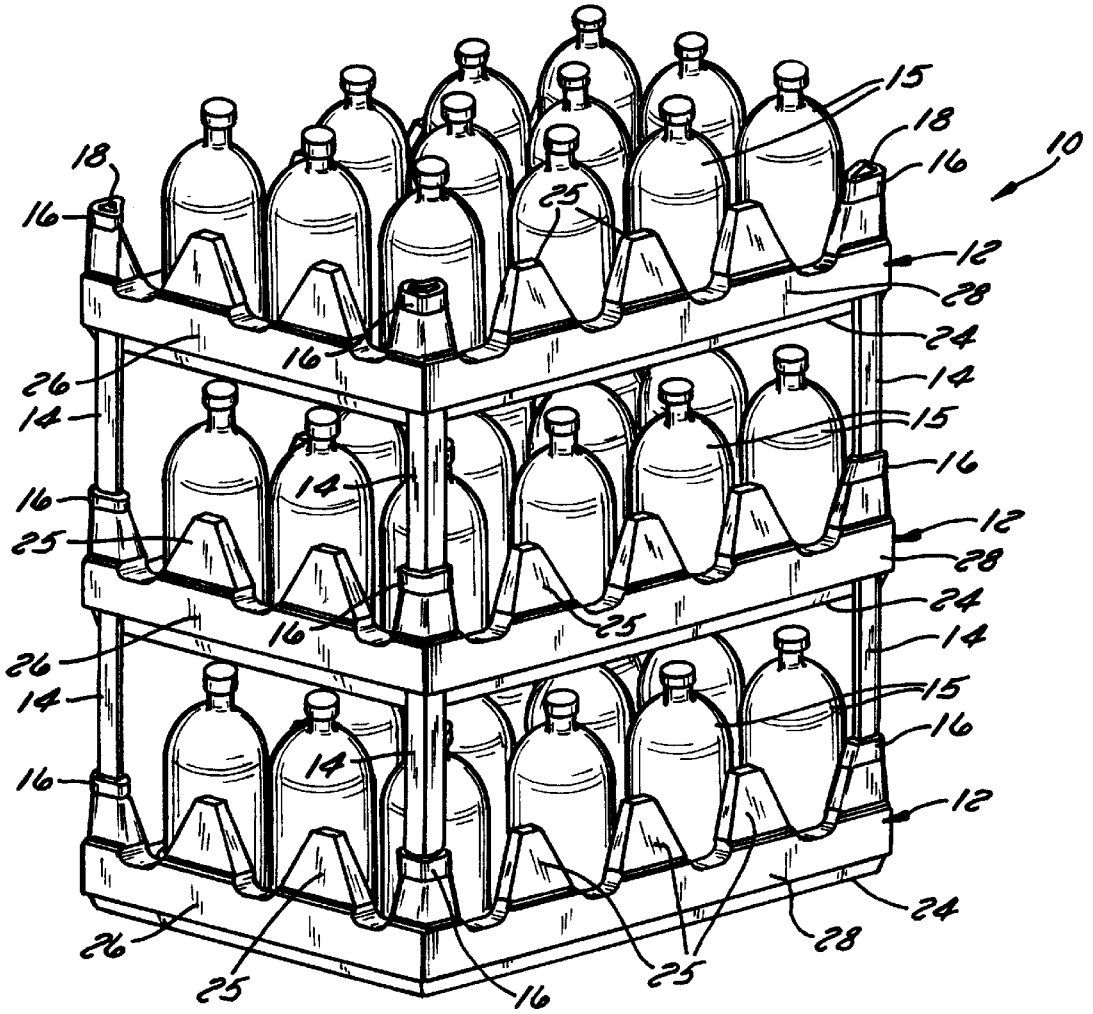
FIG. 1 is a perspective view of a display rack formed by a stack of trays.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

An exemplary embodiment of the display rack 10 according to the present invention is shown in FIGS. 1 through 6 wherein a number of trays 12 are shown supported by posts 14. Each tray is designed to hold twelve one liter bottles 15. Although the trays 12 are described as accommodating twelve bottles, smaller or larger trays can also be used to accommodate any number of bottles. Each tray 12 includes four corner pillars 16 having a recess 18 in the top and a recess 20 in the bottom. A number of flanges 22 are provided in the recess 20, FIGS. 4 and 5, located in a position to engage the top of pillar 16 when stacked for storage.

Figure 3:
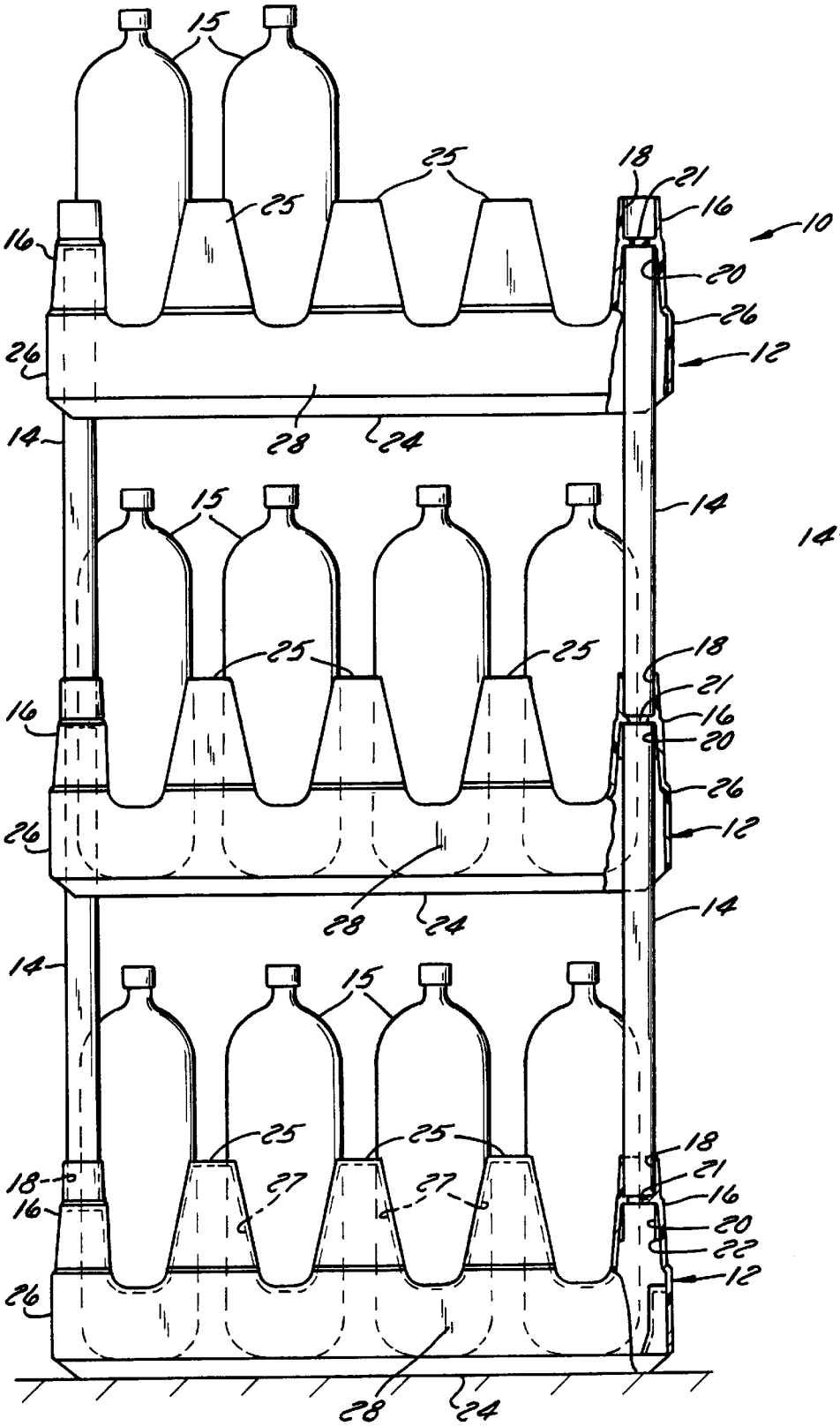
FIG. 3 is a side view of the display rack of FIG. 1.
Figure 6:
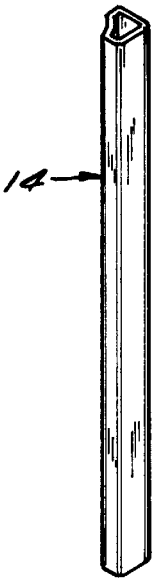
FIG. 6 is a perspective view of one of the posts.

A number of trays 12 are shown in FIG. 3 supported on triangular posts 14 which are seated in recesses 18 in the top of corner posts 16 and recesses 20 in the bottom of the corner posts 16 to provide sufficient space between the trays so that the bottles 15 can be removed from the trays.

Figure 2:
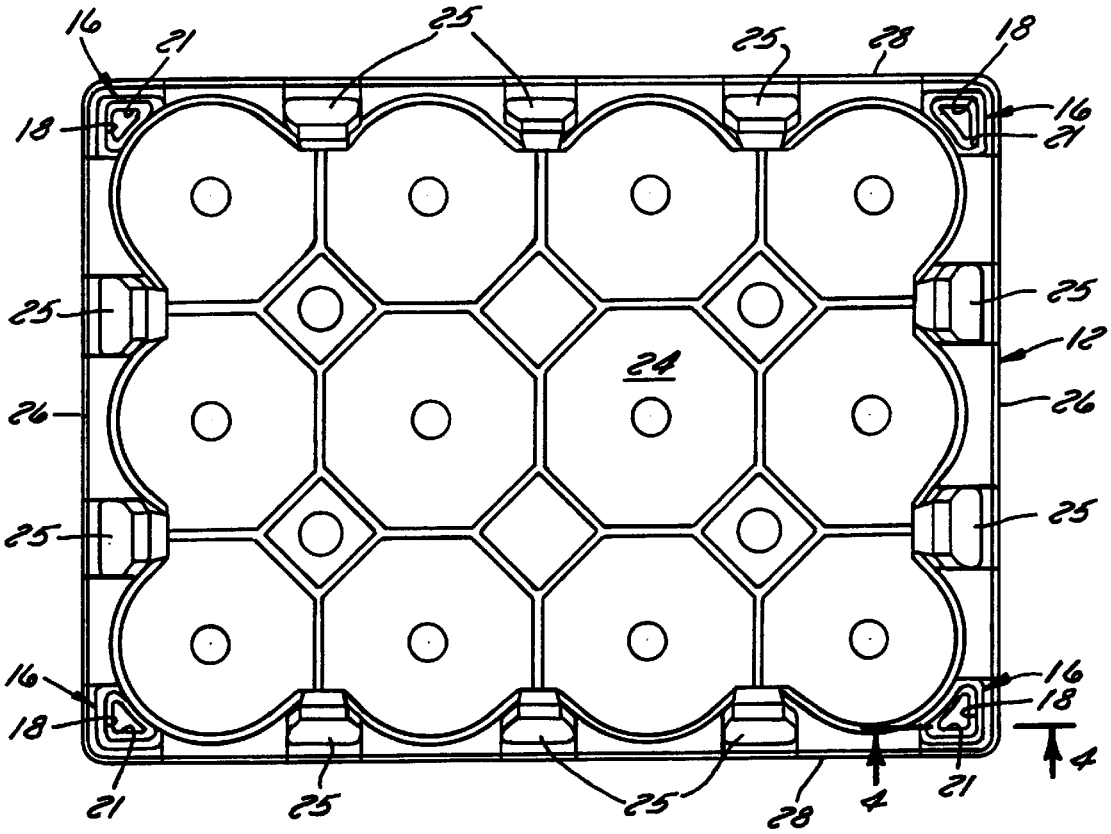
FIG. 2 is a top view of FIG. 1.
Figure 4:
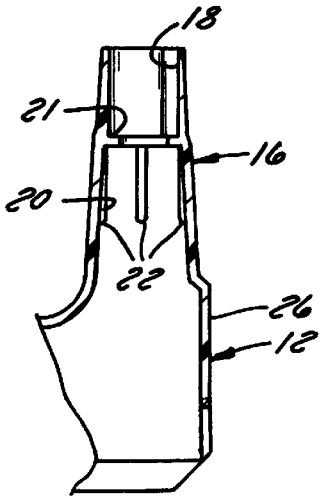
FIG. 4 is a cross section view taken on line 4—4 of FIG. 2.
Figure 5:
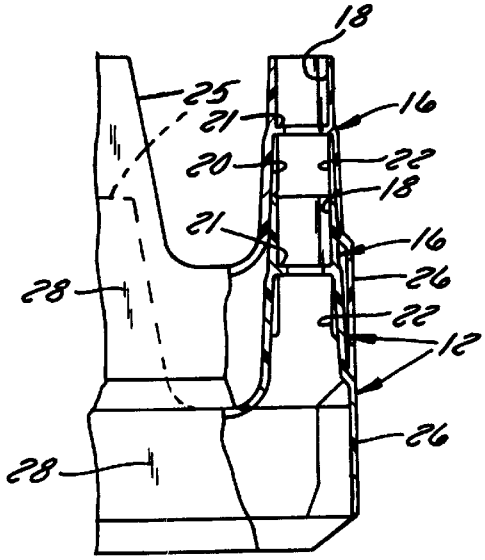
FIG. 5 is a view of the double recess corner pillars partly broken away to show the pillars stacked for storage.

More significantly, and referring to FIGS. 2 and 3, each tray generally includes a bottom panel 24, a pair of end walls 26 and a pair of side walls 28. A triangular corner pillar 16 is provided in each corner of the tray. The upper end of each pillar 16 is tapered for mating engagement with a corresponding recess 20 in the bottom of the pillar 16. A partition 21 separates the recess 18 from the recess 20. The recesses 20 are provided with vertical flanges 22 in a position to engage the top of the pillar 16 when seated for storage on the lower pillar on the lower tray. A set of triangular pillars 25 are provided on each of the side walls 28 and end walls 30. Each of the pillars 25 are also tapered to matingly engage with the recesses 27 in the corresponding pillars 25 on the upper or lower tray 12. As shown in FIG. 5 the corner posts 16 are seated in the recess 20 in the upper tray in mating engagement with flanges 22 when stacked for storage.

Figure 7:
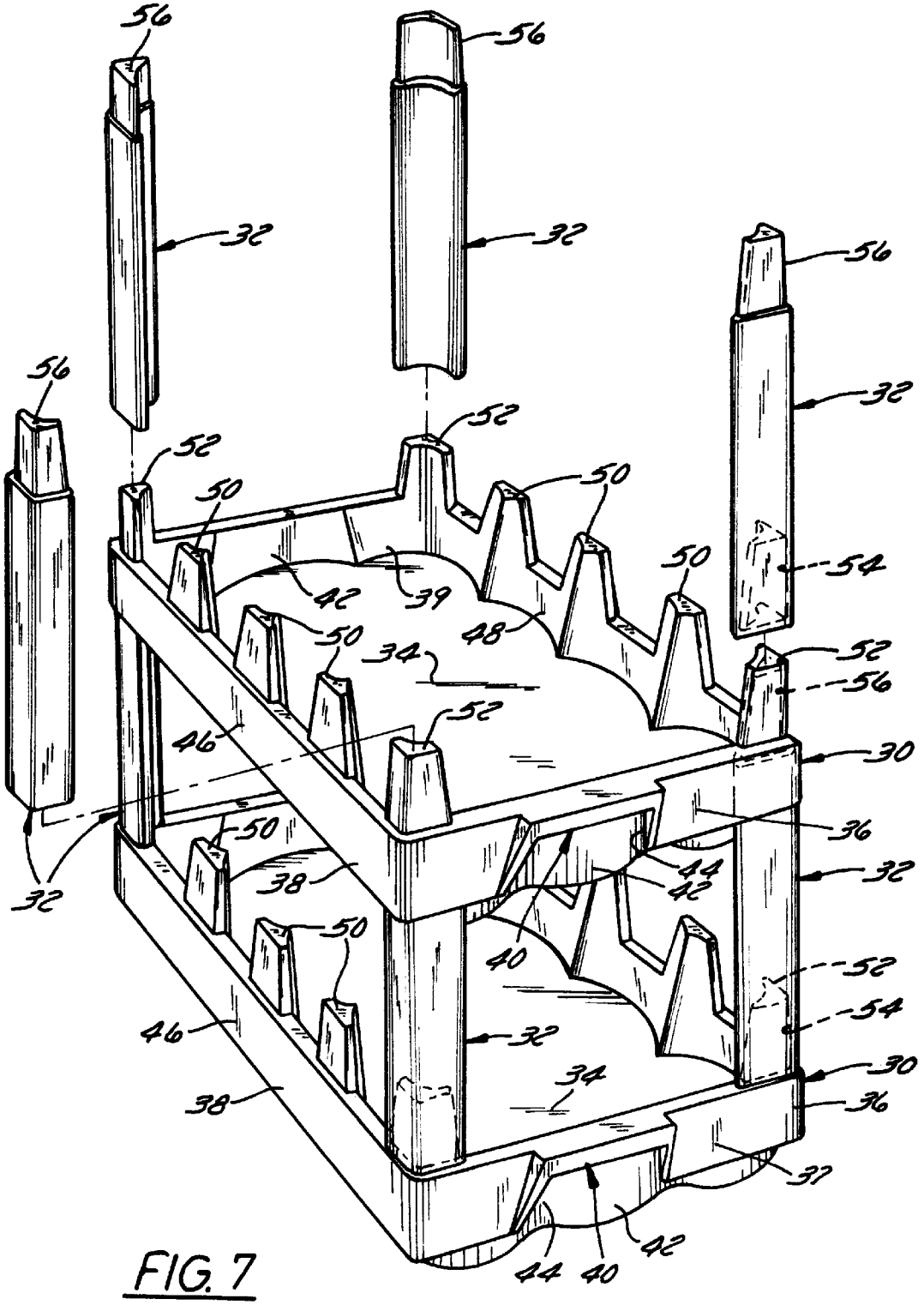
FIG. 7 is an exploded perspective view of an alternate form of tray stacked for storage.
Figure 8:
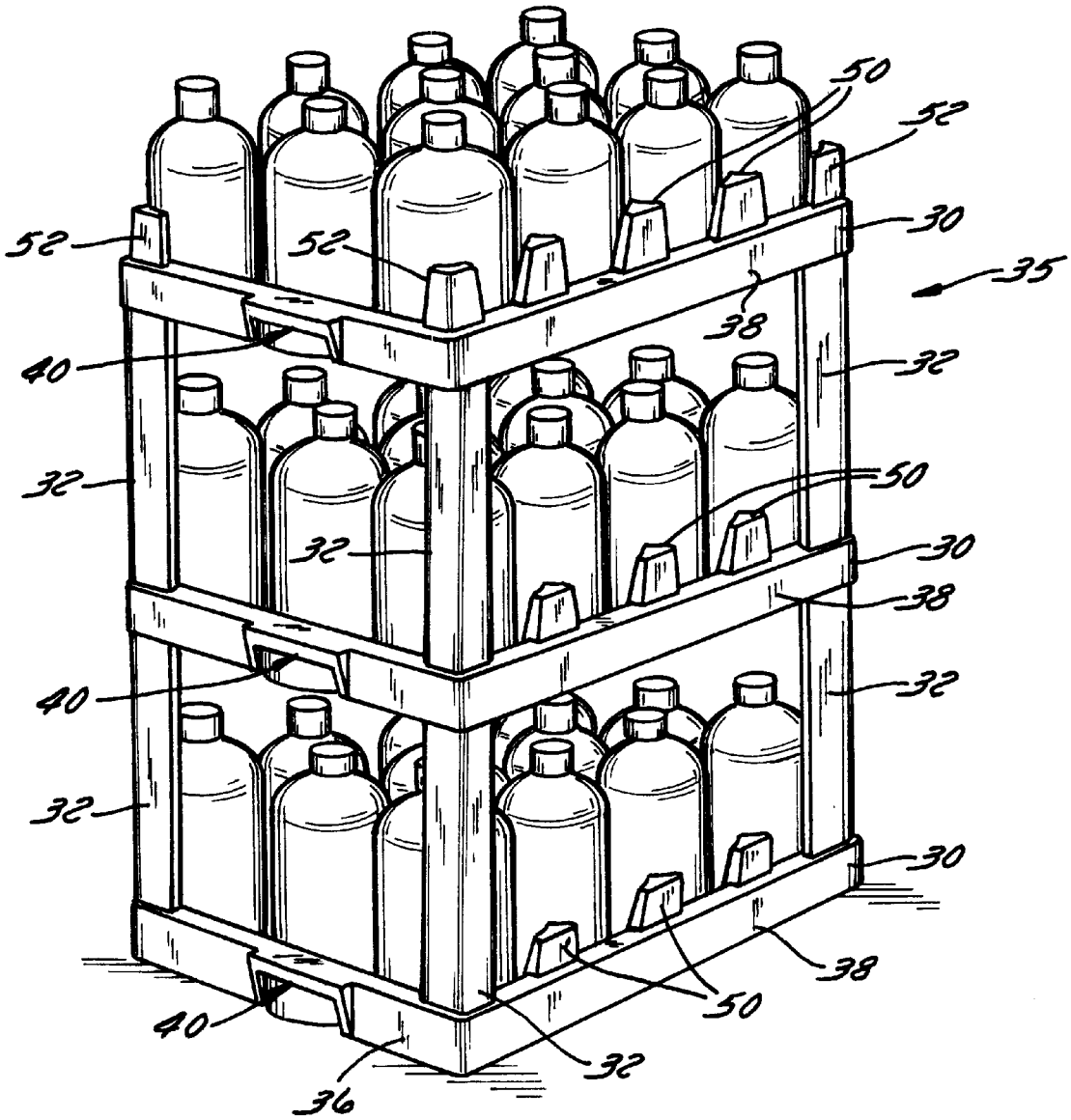
FIG. 8 is a perspective view of the alternate tray stacked to form a display rack.

An alternate form of tray 30 is shown in FIGS. 7 and 8 having triangular posts 32 for forming the display rack 35. Each tray 30 generally includes a bottom panel 34, a pair of end walls 36 and a pair of side walls 38. Each end wall 36 includes an outer wall 37 and a tapered inner wall 39. A handle 40 is formed in outer wall 37. In this regard the handle includes an inner curved wall 42 and an outer tapered recess 44 conforming to the inner curved wall 42 of the handle 40. Each side wall 38 includes an outer wall 46 and tapered inner walls 48 spaced apart sufficiently to accommodate the end walls 36 and side walls 38 on the lower tray. Each of the side walls 38 includes a number of triangular pillars 50 in the form of hollow tapered shells for matingly engaging the walls 46 and 48 on the side walls 38 of the upper and lower trays 10. The tapered handles 40 are nested in the tapered recesses 44 when stacked for storage as shown in FIG. 8 to provide a neat appearance as well as reducing the space required for storing the trays.

In accordance with the present invention the display rack is formed by mounting corner posts 32 on pillars 52 on the lower tray and aligning the upper end 56 with the corner posts 52 on the upper tray as shown in FIGS. 7 and 8. In this regard each corner post 32 includes a vertically tapered three cornered recess 54 at one end conforming generally to the shape of the corner pillars 52 and a three cornered extension 56 at the other end to matingly engage the recess 54 in the lower end of pillar 52. When the trays 30 are stacked for storage the side wall pillars 50 and corner pillars 52 in the bottom tray are aligned with the walls 46 and 48. When the trays 30 are stacked to form a display stand. The recess 54 in the lower end of post 32 is mounted on the corner pillars 52 on the lower tray and the upper three cornered extension is nested in the recess 54 in the corner pillars 52 in the upper tray.

Thus, it should be apparent that there has been provided in accordance with the present invention a display tray that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A display rack for soda bottles and the like, said rack comprising:

a number of trays for storing the soda bottles, each tray having a set of triangular pillars provided on the top of the side walls and end walls, a hollow triangular pillar on each corner of the tray, each pillar including a triangular recess in the top and bottom, a triangular post mounted in the top of each corner triangular pillar in a lower tray and the upper end of the post seated in the bottom of each corner triangular pillar in an upper tray whereby said trays are spaced apart a distance sufficient for the bottles to be removed from any tray in the display rack.

* * * * *